US008277229B2

(12) United States Patent
Chiu et al.

(10) Patent No.: US 8,277,229 B2
(45) Date of Patent: Oct. 2, 2012

(54) CONNECTOR ASSEMBLY

(75) Inventors: Po-Wen Chiu, Taipei Hsien (TW); Hai Nhu Pham, Santa Clara, CA (US)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 276 days.

(21) Appl. No.: 12/759,030

(22) Filed: Apr. 13, 2010

(65) Prior Publication Data

US 2011/0250766 A1 Oct. 13, 2011

(51) Int. Cl.
*H01R 12/00* (2006.01)

(52) U.S. Cl. ..... 439/65; 439/79; 361/785

(58) Field of Classification Search ..... 439/65, 439/55, 79; 361/785, 801, 803, 796
See application file for complete search history.

(56) References Cited

U.S. PATENT DOCUMENTS 5,488,541 A * 1/1996 Mistry et al. ..... 361/788
6,147,871 A * 11/2000 DeWitt et al. ..... 361/752
6,731,515 B2 * 5/2004 Rhoads ..... 361/796
6,808,397 B2 * 10/2004 Kondo ..... 439/76.2
7,070,431 B1 * 7/2006 White ..... 439/160
7,445,457 B1 * 11/2008 Frangioso et al. ..... 439/61

* cited by examiner

*Primary Examiner* — Xuong Chung Trans
(74) *Attorney, Agent, or Firm* — Altis Law Group, Inc.

(57) ABSTRACT

A connector assembly includes a riser card, a first connector, a bent connector, and a second connector. The riser card includes a first side and a second side. The first connector is mounted on the first side of the riser card. The first connector includes at least one first pin extending through the riser card and protruding from the second side of the riser card. The bent connector is mounted on the second side of the riser card. The bent connector is coupled with the first connector in the riser card. The bent connector includes a first portion mounted on the second side and a second portion spaced from the riser card. The second connector is connected to the second portion. A gap is defined between the second connector and the riser card, and the at least one first pin of the first connector is located in the gap to avoid interfering with the second connector.

12 Claims, 4 Drawing Sheets

CONNECTOR ASSEMBLY

BACKGROUND

1. Technical Field

The present disclosure relates to connector assemblies, and particularly to, a connector assembly for transmitting signals between different electronic components.

2. Description of Related Art

Connectors are widely used in computers or servers to transmit power or signals between different electronic components. Referring to FIG. 1, a prior art connector assembly for transmitting power is shown. The prior art connector assembly comprises a converter card 90 with a plurality of power supply unit connectors 901 mounted thereon, a transmitting card 91, a riser card 92, and a printed circuit board (PCB) 95 with a board connector 951 mounted thereon. The plurality of power supply unit connectors 901 is capable of connecting to a plurality of power supply units. The converter card 90 processes the power, and transmits the power to the riser card 92 via the transmitting card 91. The riser card 92 is inserted in the board connector 951 for providing power to the PCB 95. In the prior art connector assembly, the power supply unit connectors 901 usually have some pins 902 extending through the converter card 90. The transmitting card 91 separates the converter card 90 and the PCB 95 to avoid them interfering with each other. However, the prior art connector assembly has too many components, which is complex, and costly.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 2:
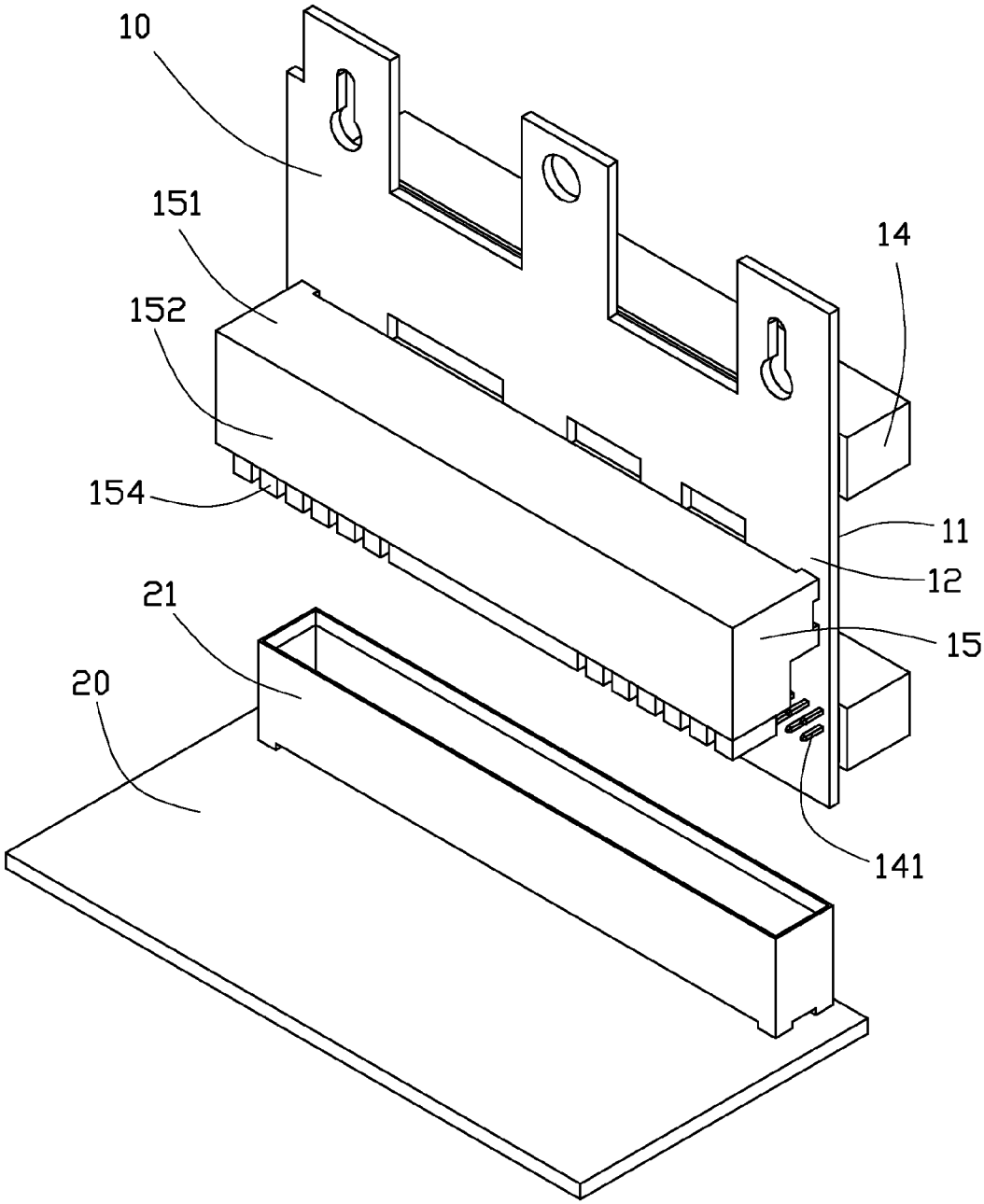
FIG. 2 is an isometric and exploded view of a connector assembly an embodiment.
Figure 3:
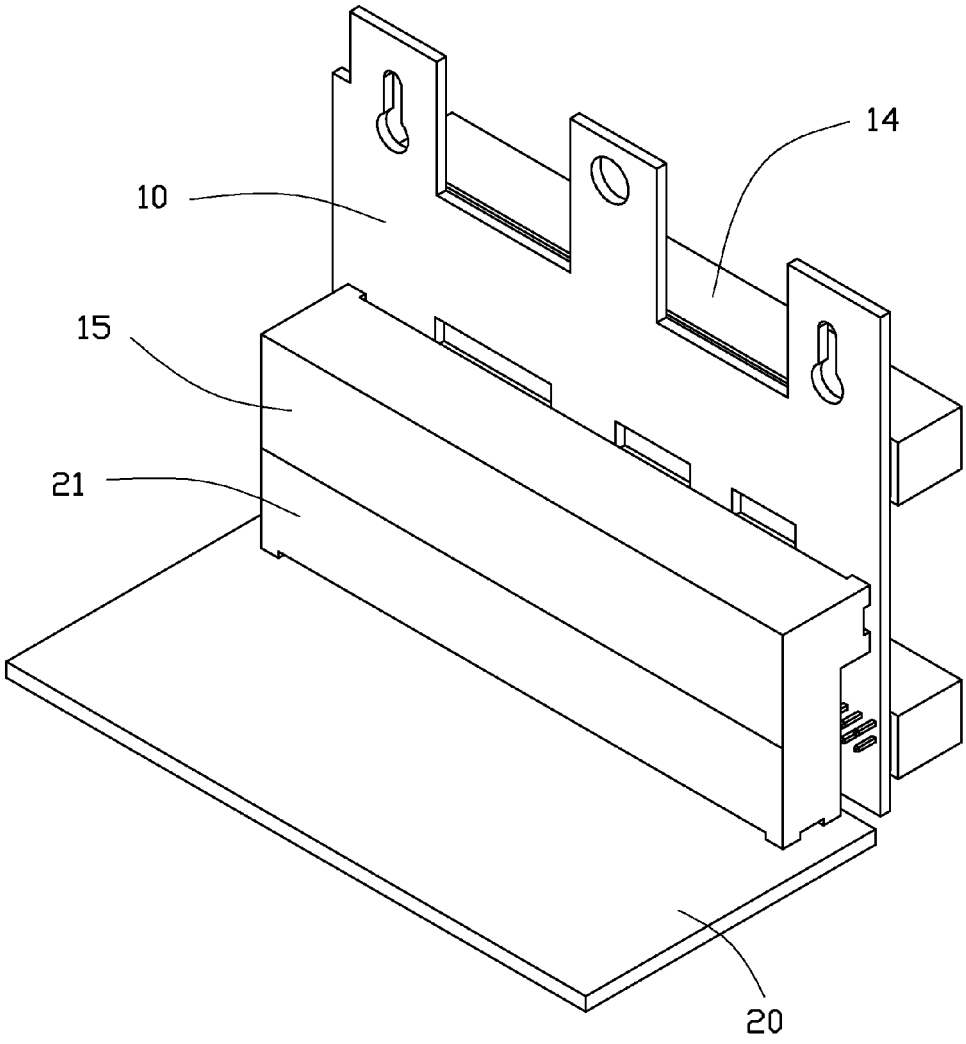
FIG. 3 is an isometric and assembled view of the connector assembly of FIG. 2.
Figure 4:
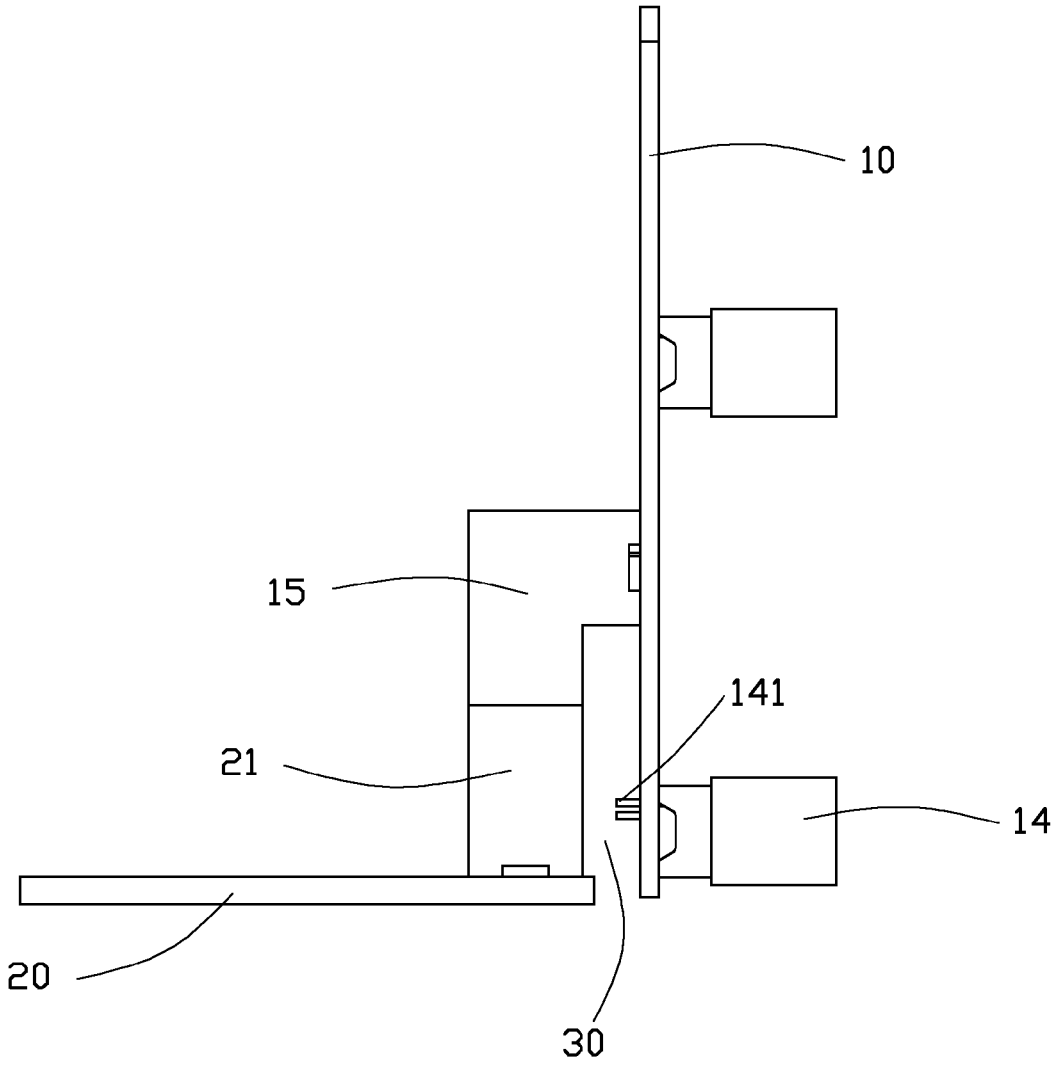
FIG. 4 is a side view of the connector assembly of FIG. 3.

Referring to FIGS. 2 to 4, a connector assembly in accordance with an embodiment of the present disclosure, includes a riser card 10 and a printed circuit board (PCB) 20. The riser card 10 includes a first side 11 and a second side 12 opposite to the first side 11. The first side 11 of the riser card 10 is mounted with at least one first connector 14. In one embodiment, there are two first connectors 14 mounted on the first side 11 adapted for connecting to two power supply units. The first connectors 14 extend in a first direction which is substantially perpendicular to the riser card 10. The first connectors 14 are capable of connecting to the corresponding power supply units in the first direction. Each first connector 14 includes a plurality of first pins 141 extending in the first direction. Some of the first pins 141 are very long and extend through the riser card 10.

The second side 12 of the riser card 10 is mounted with a bent connector 15. The bent connector 15 is formed in "L" shape, and includes a first portion 151 extending in the first direction and a second portion 152 extending in a second direction which is perpendicular to the first direction. The first portion 151 is mounted on the second side 12 of the riser card 10. The second portion 152 is substantially parallel to the riser card 10, and includes a plurality of second pins 154 extending in the second direction therein. The second portion 152 is spaced a distance away from the riser card 10. The bent connector 15 is coupled with the two first connectors 14 in the riser card 10.

The PCB 20 includes a second connector 21. The second connector 21 includes a plurality of pads (not shown) corresponding to the second pins 154 of the bent connector 51.

In assembly, the second portion 152 of the bent connector 15 is connected with the second connector 21 in the second direction. The second pins 154 of the bent connector 15 are coupled to corresponding pads of the second connector 21. A gap 30 (see FIG. 4) is defined between the second connector 21 and the riser card 10. The first pins 141 of the corresponding first connector 14 are received in the gap 30 to avoid interfering with the second connector 21. Therefore, after the first connectors 14 are connected to corresponding electronic components, such as power supply units, communication between the electronic components and the PCB 20 are achieved by the above connector assembly.

Figure 1:
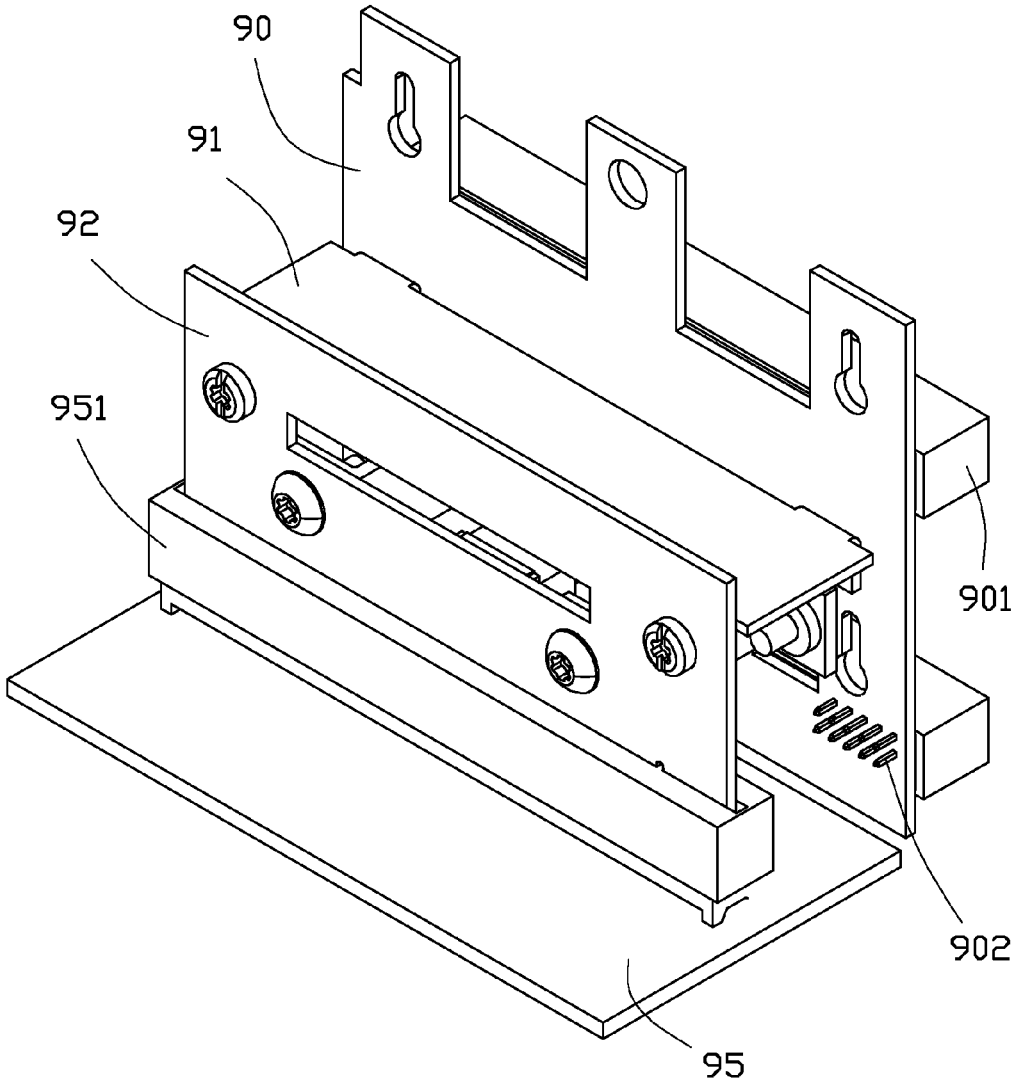
FIG. 1 (PRIOR ART)
FIG. 1 is an isometric view of a connector assembly, according to the prior art.

In the embodiment shown in FIGS. 2 to 4, the riser card 10 is conveniently connected to the PCB 20 via the bent connector 15. The connect assembly of the above embodiment is compact, and occupies less space than the prior art connect assembly of FIG. 1, and uses fewer components.

Various spacers, standoffs, extenders and so on, can be added between the first portion 151 of the bent connector 15 and the riser card 10 to widen a width of the gap 30. Therefore, other pins, which are longer than the pins 141, can be received in the gap 30. Furthermore, a width of the first portion 151 of the bent connector 15 can be changed to adjust the size of the gap 30.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A connector assembly, comprising:

a riser card comprising a first side and a second side;

a first connector mounted on the first side, the first connector comprising at least one first pin extending through the riser card and protruding from the second side of the riser card;

a bent connector mounted on the second side of the riser card, the bent connector coupled with the first connector; the bent connector comprising a first portion and a second portion, the first portion mounted on the second side of the riser card, the second portion spaced from the riser card; and a second connector connected to the second portion, a gap defined between the second connector and the riser card, and the at least one first pin of the first connector located in the gap, a distance between the second connector and the riser card being greater than a length of a portion of the at least one first pin protruding from the second side of the riser card.

2. The connector assembly of claim 1, wherein the at least one first pin extends in a first direction that is substantially perpendicular to the riser card, and the second connector extends in a second direction that is substantially parallel to the riser card.

3. The connector assembly of claim 2, wherein the first portion of the bent connector extends in the first direction, and the second portion of the bent connector extends in the second direction.

4. The connector assembly of claim 3, wherein the second portion and the riser card also defines a gap therebetween.

5. The connector assembly of claim 1, wherein the second connector is mounted on a printed circuit board, and the first connector is capable of connecting to a power supply unit for providing power to the printed circuit board.

6. The connector assembly of claim 1, wherein the bent connector has an "L" shape.

7. A connector assembly, comprising:

a riser card comprising a first side and a second side opposite to the first side;

a first connector mounted on the first side, the first connector comprising a plurality of first pins extending through the riser card and projecting from the second side of the riser card; and a bent connector mounted on the second side of the riser card, the bent connector coupled with the first connector; the bent connector comprising a first portion and a second portion, the first portion mounted on the second side of the riser card, the second portion spaced from the riser card and defining a gap between the second portion and the riser card, and the plurality of first pins located in the gap, a distance between the second portion and the riser card being greater than a length of a portion of the at least one of the plurality of first pins projecting from the second side of the riser card.

8. The connector assembly of claim 7, further comprising a second connector connected to the second portion.

9. The connector assembly of claim 8, wherein the plurality of first pins extends in a first direction that is substantially perpendicular to the riser card, and the second connector extends in a second direction that is substantially parallel to the riser card.

10. The connector assembly of claim 9, wherein the first portion of the bent connector extends in the first direction, and the second portion of the bent connector extends in the second direction.

11. The connector assembly of claim 9, wherein the second connector is mounted on a printed circuit board, and the first connector is capable of connecting to a power supply unit for providing power to the printed circuit board.

12. The connector assembly of claim 11, wherein the bent connector has an "L" shape.

* * * * *